US006066008A

United States Patent [19]

Brantingham et al.

[11] Patent Number: 6,066,008

[45] Date of Patent: May 23, 2000

[54] ELECTRICAL CONNECTOR WITH TERMINAL LOCK

[75] Inventors: Duane Lee Brantingham, Cortland, Ohio; Marco Rollero, Turin, Italy

[73] Assignee: General Motors Corporation, Detroit, Mich.

[21] Appl. No.: 09/128,136

[22] Filed: Aug. 3, 1998

[51] Int. Cl.[7] ..... H01R 13/436

[52] U.S. Cl. ..... 439/752; 439/595

[58] Field of Search ..... 439/752, 595

[56] References Cited

U.S. PATENT DOCUMENTS

| | | | |
|---|---|---|---|
| 4,066,325 | 1/1978 | Pearce, Jr. et al. . | |
| 4,319,799 | 3/1982 | Pearce, Jr. . | |
| 4,329,009 | 5/1982 | Bungo . | |
| 4,352,535 | 10/1982 | McNamee, Sr. et al. . | |
| 4,452,501 | 6/1984 | Gladd et al. . | |
| 5,044,991 | 9/1991 | Colleran et al. | 439/595 |
| 5,122,080 | 6/1992 | Hatagishi et al. | 439/595 |
| 5,433,619 | 7/1995 | Maejima . | |
| 5,830,013 | 11/1998 | Saito et al. | 439/752 |

*Primary Examiner*—Gary F. Paumen
*Attorney, Agent, or Firm*—Patrick M. Griffin

[57] ABSTRACT

An electrical connector includes a molded plastic connector body that is equipped with a moveable terminal lock member. The lock member includes flexible terminal latches and rigid terminal locks. The lock member is attached to the connector body in a pre-stage position where the flexible terminal latches are positioned to hold terminals in terminal cavities as the terminals are loaded into the plastic connector body. After the terminals are loaded, the lock member is moved to a lock position where the terminals are held by the rigid terminal locks.

5 Claims, 3 Drawing Sheets

ELECTRICAL CONNECTOR WITH TERMINAL LOCK

TECHNICAL FIELD

This invention relates generally to electrical connectors and more particularly to electrical connectors that have terminal locks.

BACKGROUND OF THE INVENTION

Electrical connectors typically comprise a molded plastic connector body having terminal cavities that receive metal terminals that are attached to the ends of electric cables. The terminal cavities receive the metal terminals individually and isolate the metal terminals from each other to prevent shortages. Each metal terminal typically has a resilient or flexible latch tang that holds the metal terminal in its particular cavity. Such electrical connectors are also known to include a rigid terminal lock that is attached to the connector body to hold the terminals after all the terminals have been loaded into the terminal cavities. Such an arrangement is shown in U.S. Pat. No. 4,352,535 granted to James W. McNamee, Sr. and Daniel N. Kosareo Oct. 5, 1982 for an electrical connector. This patent discloses an electrical connector in which metal terminals are loaded into terminal cavities and initially held in the terminal cavities by flexible latch tangs of the metal terminals engaging shoulders in the terminal cavities of the connector body. A lock bar is then attached to the connector body to provide a rigid terminal lock for the terminals in each row. See also U.S. Pat. No. 4,066,325 granted to Warren Pearce, Jr. and Andrew Russo, Jr. Jan. 3, 1978 and U.S. Pat. No. 4,319,799 granted to Warren Pearce, Jr. Mar. 16, 1982 for similar arrangements.

U.S. Pat. No. 4,329,009 granted to Edward M. Bungo May 11, 1982 shows an arrangement where the connector body has a flexible portion that engages a rigid portion of a metal terminal to hold the terminal in a terminal cavity of the connector body. A lid is then closed to hold the flexible portion in place.

SUMMARY OF THE INVENTION

The object of this invention is to provide an electrical connector in which a connector body has flexible portions for retaining metal terminals in terminal cavities of the connector body during the loading process and rigid portions for locking the metal terminals in the terminal cavities after the terminals are loaded.

A feature of the invention is that the electrical connector includes a moveable member that has flexible portions for retaining metal terminals in terminal cavities during the loading process and rigid portions for locking the terminals in the cavities after loading is completed.

Another feature of the invention is that the electrical connector includes a moveable lock member that is attached to the connector body in a pre-stage position to hold metal terminals in terminal cavities with resilient portions during the loading process and then moved to a lock position to hold the metal terminals in the terminal cavities with rigid portions.

Another feature of the invention is that the electrical connector has a connector body that has terminal cavities with smooth walls that are easy to mold.

Another feature of the invention is that the electrical connector has a moveable lock member that has rigid portions for locking several rows of metal terminals in their respective terminal cavities.

Yet another feature of the invention is that the electrical connector has a lock member that is movable from a pre-stage position to a lock position to lock the terminals in the terminal cavities with rigid portions but that is blocked from such movement if the metal terminals are not properly located in the terminal cavities.

Still another feature of the invention is that the electrical connector has a moveable lock member that guides the metal terminals into terminal cavities during the terminal loading process.

These and other objects, features and advantages of the invention will become more apparent from the following description of a preferred embodiment taken in conjunction with the accompanying drawing.

DESCRIPTION OF THE PREFERRED EMBODIMENT

Figure 1:
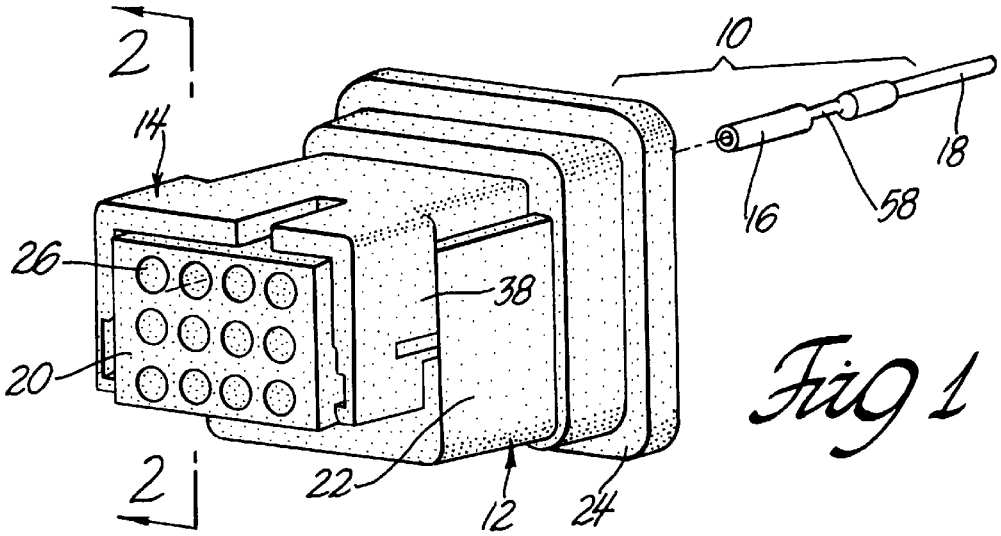
FIG. 1 is a front perspective view of an electrical connector in accordance with the invention.

Referring now to FIG. 1, an electrical connector 10 of the invention comprises a molded plastic connector body 12 and a molded plastic lock member 14 for retaining metal terminals 16 attached to the ends of electric cables 18 in terminal cavities in connector body 12.

Figure 3:
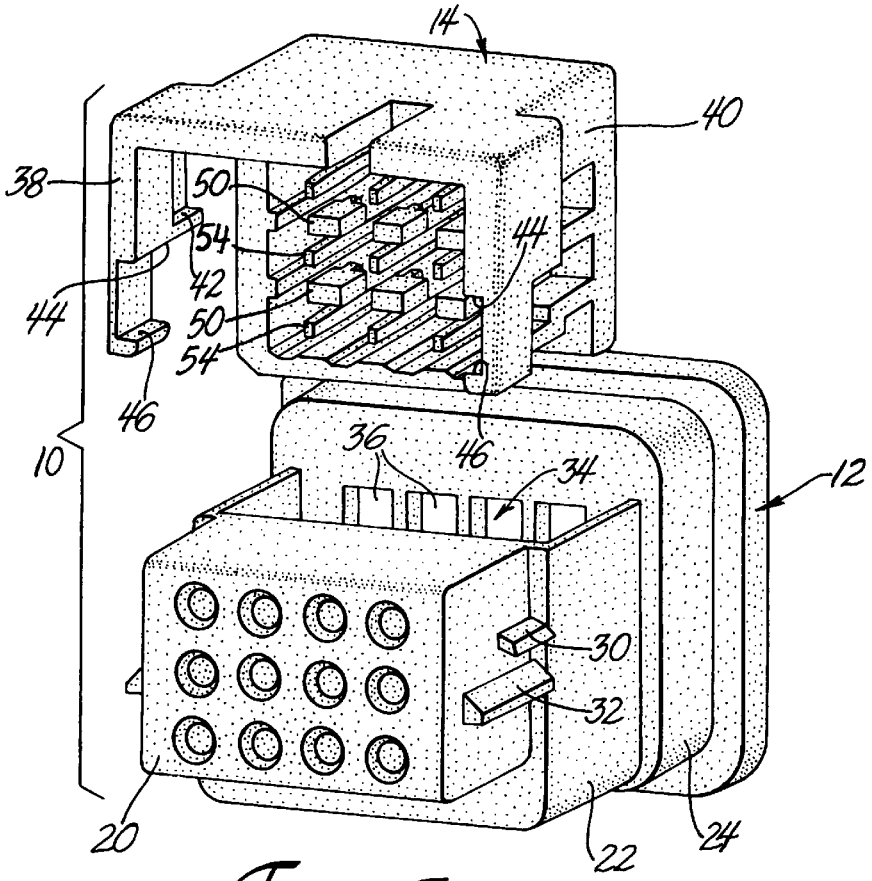
FIG. 3 is an exploded front perspective view of the electrical connectors shown in FIGS. 1 and 2.

Connector body 12 has a forward portion 20, an intermediate portion 22 and a rearward portion 24. Forward portion 20 has a plurality of terminal cavities 26 that extend through the forward portion 20 in the longitudinal direction. The terminal cavities 26 are smooth cylinders of substantially constant diameter with an inward circumferential lip 28 at the forward end that serves as a terminal stop. (In the example shown, the terminal cavities 26 are arranged in horizontal and vertical rows with four cavities in each horizontal row and three cavities in each vertical row. However, each horizontal and vertical row can have more or less cavities than the number shown.) The side walls of the forward portion 20 each have a short upper lock nib 30 and a long lower lock nib 32 as best shown in FIG. 3.

Intermediate portion 22 is a hollow, box-like structure that is open at the top. Intermediate portion 22 receives a lock portion of lock member 14 for movement relative to connector body 12 as explained below.

Figure 2:
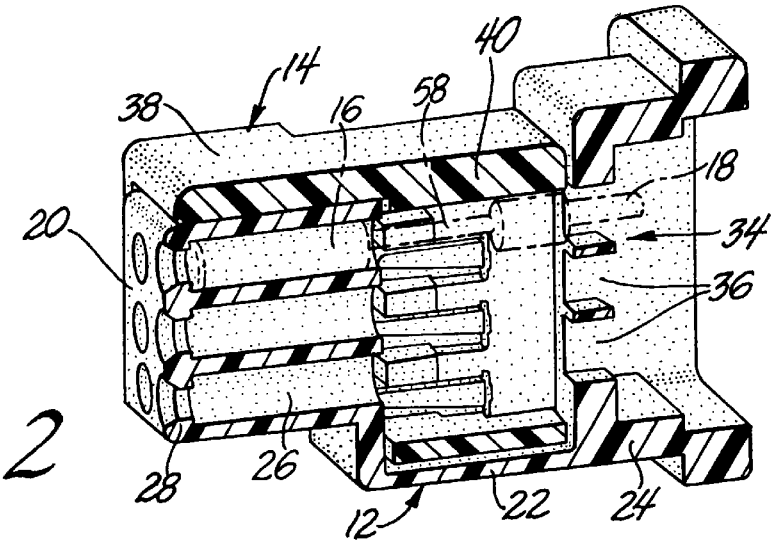
FIG. 2 is a longitudinal section of the electrical connector taken substantially along the line 2—2 of FIG. 1 looking in the direction of the arrows.
Figure 4:
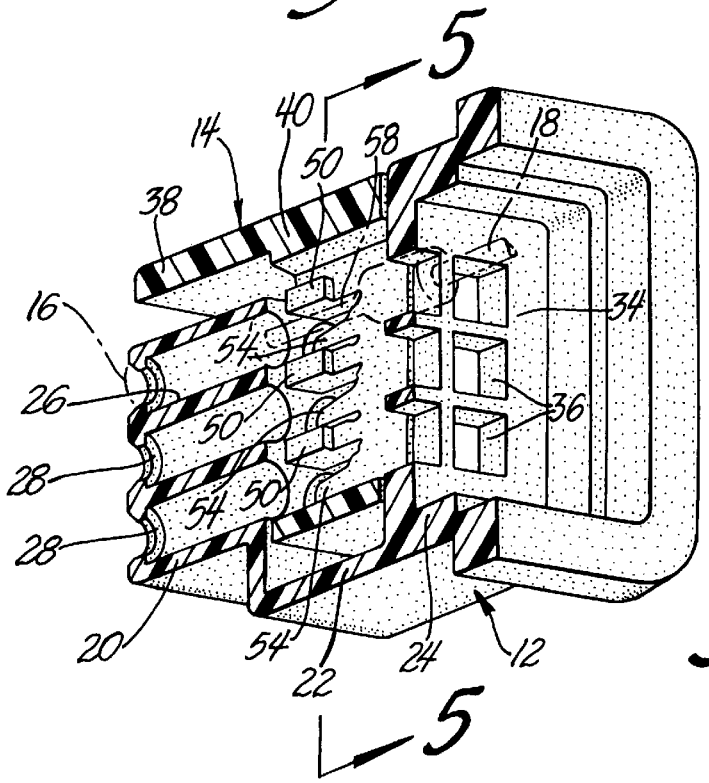
FIG. 4 is a sectioned perspective rear view of the electrical connector showing the lock member in the pre-stage position.

Rear portion 24 has a grid 34 that defines a plurality of rectangular openings 36 that are aligned with respective ones of the cylindrical terminal cavities 26 in the longitudinal direction as best shown in FIGS. 2 and 4.

Lock member 14 has a forward U-shaped shroud 38 and a rearward rectangular body 40. Forward shroud 38 embraces the forward portion 20 of connector body 12 and the rearward rectangular body 40 fits into the hollow structure of intermediate connector body portion 22.

Figure 5:
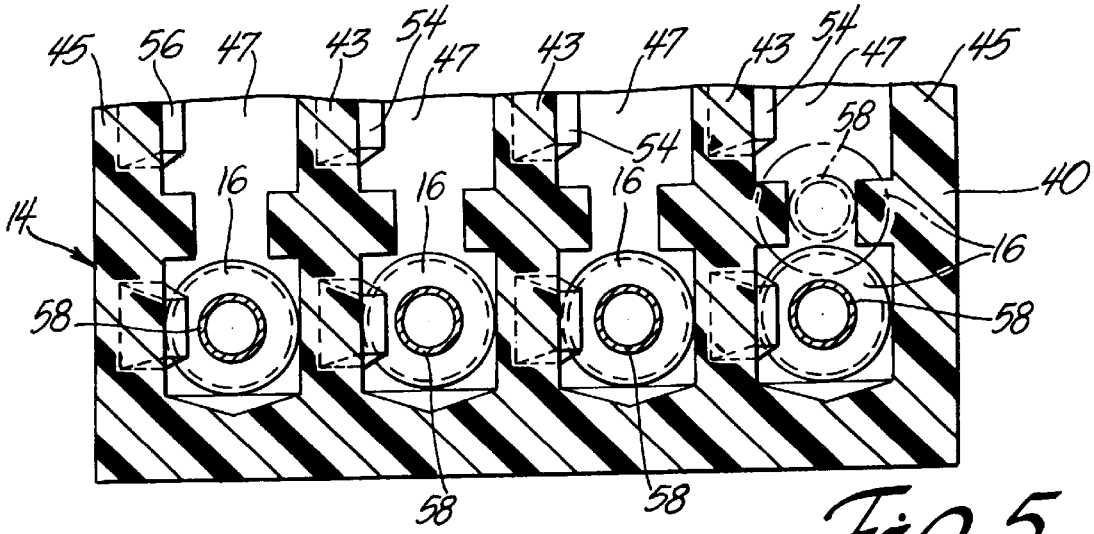
FIG. 5 is a section taken substantially along the line 5—5 of FIG. 4 looking in the direction of the arrows.

Lock member 14 is attached to connector body 12 for movement between a pre-stage position shown in FIGS. 4 and 5 and a lock position shown in FIGS. 1 and 2. Each side wall of the forward shroud 38 of lock member 14 has three lock shoulders 42, 44 and 46 as best shown in FIG. 3. When lock member 14 is assembled to connector body 12, the rectangular portion 40 is inserted into the hollow intermediate portion 22 of connector body 12 and pushed down until intermediate lock shoulders 44 engage the upper surface of upper lock nibs 30 and lower lock shoulders 46 snap over the lower lock nibs 32. This holds the lock member 14 in the pre-stage position where the lock member is raised with respect to the connector body 12 as best shown in FIG. 4. Lock member 14 is moved from this pre-stage position to the lock position by pushing down on lock member 14 until upper lock shoulders 42 snap over the upper lock nibs 30 and engage the lower surfaces of the upper lock nibs 30. This holds the lock member in the lock position where the forward shroud 38 of lock member 14 engages the forward portion 20 of connector body 12 on three sides and the rearward rectangular portion 40 of lock member 14 bottoms out in the hollow intermediate portion 22 of the connector body 12 as best shown in FIGS. 1 and 2.

Figure 6:
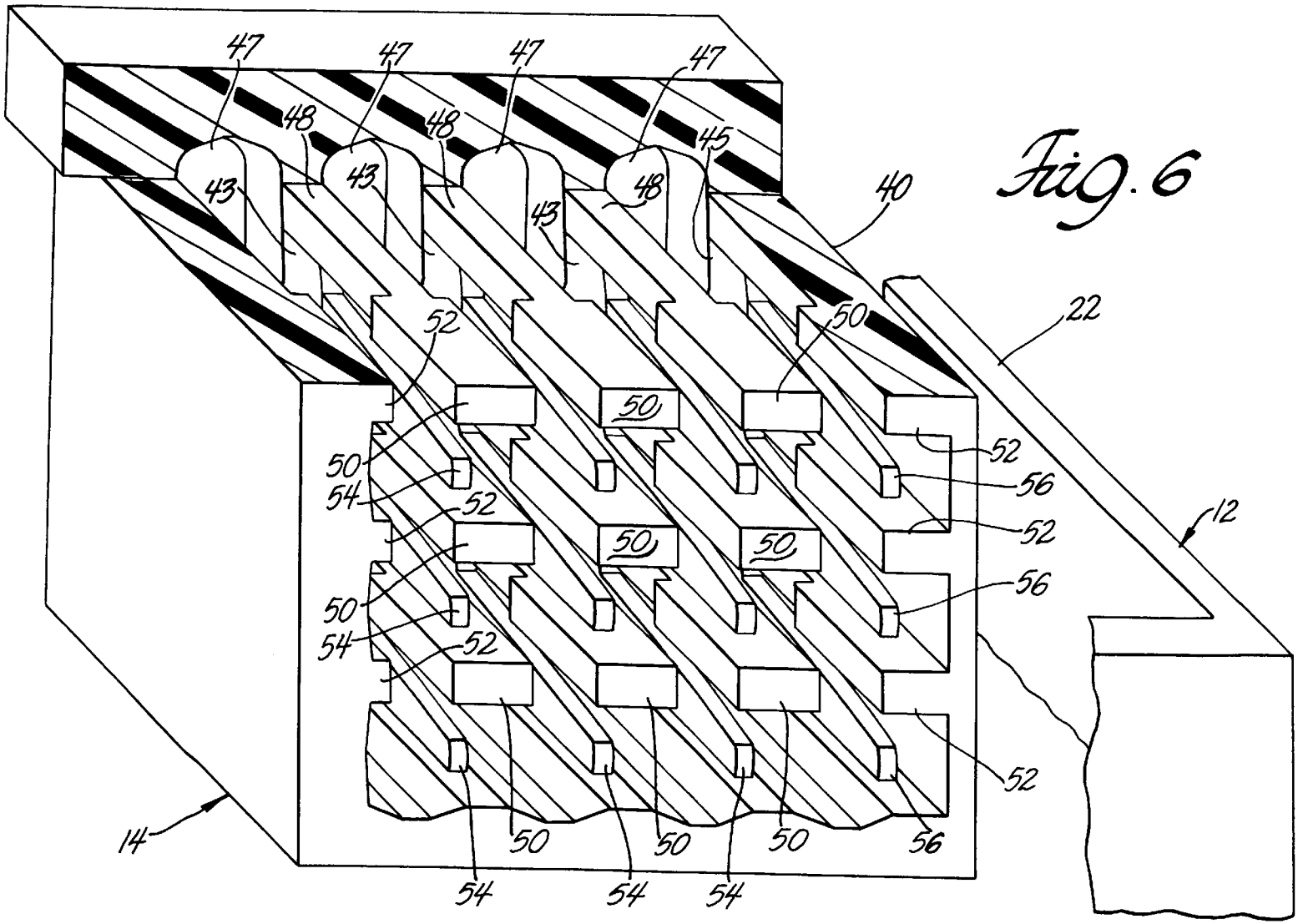
FIG. 6 is a front perspective view of the lock member.

The rectangular portion 40 of lock member 14 has a plurality of interior vertical walls 43 at the rear end (FIG. 6) that are aligned with the vertical walls of the grid 34 in the rear portion 24 of connector body 12 (FIGS. 3 and 4). The two exterior vertical walls 45 and three interior vertical walls 43 form four vertical channels 47 that are aligned with the four vertical rows of terminal cavities 26 respectively.

Each interior vertical wall 43 has three rigid longitudinal fingers 48 that are vertically spaced and that have wide end portions that protrude into channels 47 to provide terminal locks 50. Exterior walls 45 also have protrusions in the end channels that provide terminals locks 52 aligned with terminal locks 50 in the horizontal direction.

Each interior vertical wall 43 also has three flexible longitudinal fingers that are vertically spaced from the rigid longitudinal fingers 48 (and terminal locks 50) and that slant forwardly into one of the vertical channels to provide flexible latch tangs 54. One of the exterior walls 46 also has three flexible longitudinal fingers that are vertically spaced from terminal locks 52 and that slant forwardly into one of the vertical end channels 46 to provide flexible latch tangs 56.

When lock member 14 is in the pre-stage position, the flexible latch tangs 54 and 56 are aligned with the openings 36 in grid 34 and the terminal cavities 26 in the forward portion 20 of the connector body 12 as shown in FIGS. 4 and 5. Terminals 16 are then inserted into the openings 36 in grid 34 and loaded into the terminal cavities 26 with the channels 47 and terminal locks 50 and 52 guiding the terminals 16 from the grid openings 36 into the respective terminal cavities 26. Terminals 16 have intermediate lock necks 58. As terminals 16 pass through portion 40 of lock member 14, the flexible latch tangs 54 and 56 engage in the intermediate lock necks 58 to retain the terminals 16 in the terminal cavities 26 in the rearward direction. Terminals 16 are retained in the terminal cavities 26 in the forward direction by inward lips 28. The bottom horizontal row of terminals 16 are shown in loaded and flexibly retained positions in FIG. 5. A typical terminal 16 is shown in a loaded and flexibly retained position in phantom in FIG. 4.

After all of the terminals 16 are loaded and properly retained in the terminal cavities 26 by the flexible latch tangs 54 and 56, lock member 14 is shifted downwardly to the lock position shown in FIGS. 1 and 2 where the rigid terminal locks 50 and 52 engage in terminal lock necks 58 to lock the terminals 16 in place in the terminal cavities 26. A typical terminal 16 is shown in a loaded and rigidly retained position in phantom in FIG. 2. The position of the typical rigidly retained terminal 16 with respect to lock member 14 is shown in phantom in FIG. 5. It should be noted that lock member 14 cannot be shifted downwardly unless all of the terminals 16 are properly located in terminal cavities 26 so that the terminal locks 50 and 52 are aligned with the terminal lock necks 58.

One or more terminals 16 can be removed from electrical connector 10 by shifting lock member 14 upwardly to the pre-stage position shown in FIGS. 4 and 5 where the terminals 16 are held individually by one of the flexible latch tangs 54 or 56. Selected terminals 16 can then be removed by depressing the associated latch tang 54 or 56 with a pick which is a well known tool and technique for terminal removal.

While the electrical connector 10 is illustrated as having twelve terminal cavities in a 3×4 arrangement, it is to be understood that arrangements with any number of vertical and horizontal rows with any number of any terminal cavities in the rows may be used. In other words, the invention has been described in an illustrative manner, and it is to be understood that the terminology, which has been used, is intended to be in the nature of words of description rather than of limitation.

Obviously, many modifications and variations of the present invention in light of the above teachings may be made. It is, therefore, to be understood that, within the scope of the appended claims, the invention may be practiced otherwise than as specifically described.

What is claimed is:

1. An electrical connector comprising:

a molded plastic connector body having a plurality of terminal cavities arranged in several vertical and horizontal rows, terminals attached to the ends of electric cables and disposed in the terminal cavities a forward portion of the connector body, and a lock member that is disposed in an intermediate hollow portion of the connector body for holding the terminals in the terminal cavities, the lock member being moveably attached to the connector body and having a pre-stage position and a lock position with respect to the connector body, the lock member having a plurality of flexible latch tangs engaging the terminals to hold the terminals in the terminal cavities when the lock member is in the pre-stage position, the lock member having a plurality of rigid terminal locks engaging the terminals to hold the terminals in the terminal cavities when the lock member is in the lock position, the connector body having a rearward portion that has a grid that defines a plurality of rectangular openings that are aligned with respective ones of the terminal cavities, and wherein the terminal cavities are aligned in a number of vertical rows and wherein the lock member has a corresponding number of vertical channels that are aligned with respective ones of the vertical rows of terminal cavities and the plurality of rigid terminal locks guide the terminals from the grid into the terminal cavities when the lock member is in the pre-stage position, the rigid terminal locks locking the terminals in the terminal cavities when the lock member is in the lock position.

2. An electrical connector comprising:

a molded plastic connector body having a plurality of terminal cavities arranged in several vertical and horizontal rows, terminals attached to the ends of electric cables and disposed in the terminal cavities that are in a forward portion of the connector body, and a lock member that is disposed in an intermediate hollow portion of the connector body for holding the terminals in the terminal cavities, the lock member being moveably attached to the connector body and having a pre-stage position and a lock position with respect to the connector body, the lock member having a plurality of flexible latch tangs engaging the terminals to hold the terminals in the terminal cavities when the lock member is in the pre-stage position, the lock member having a plurality of rigid terminal locks engaging the terminals to hold the terminals in the terminal cavities when the lock member is in the lock position, and the lock member having a forward shroud that embraces the forward portion of the connector body to hold the lock member in the pre-stage position or in the lock position.

3. The electrical connector as defined in claim 2 wherein the lock member has a plurality of rigid locks that are vertically spaced and guide the terminals from the grid into the terminal cavities and a plurality of flexible latch tangs that are vertically spaced from the rigid locks and hold the terminals in the terminal cavities when the lock member is in the pre-stage position.

4. The electrical connector as defined in claim 3 wherein the rigid locks hold the terminals in the terminal cavities when the lock member is in the lock position.

5. The electrical connector as defined in claim 2 wherein the shroud has two side wall, each of which has upper, intermediate and lower lock shoulders, wherein the forward portion of the connector body has two side walls, each of which has upper and lower lock nibs, wherein the intermediate lock shoulders engage upper surfaces of the upper lock nibs and the lower lock shoulders snap over the lower lock nibs to hold the shroud in the pre-stage position, and wherein the upper lock shoulders snap over and engage lower surfaces of the upper lock nibs to hold the shroud in the lock position.

* * * * *